US006026509A

United States Patent [19]

Bachner, Jr.

[11] Patent Number: 6,026,509

[45] Date of Patent: Feb. 22, 2000

[54] BALLISTIC RESISTANT GARMENT WITH MULTI-PANEL RADIAL SECUREMENT STITCHING

[75] Inventor: Thomas E. Bachner, Jr., Eastport, Mich.

[73] Assignee: Second Chance Body Armor, Inc., Central Lake, Mich.

[21] Appl. No.: 09/154,110

[22] Filed: Sep. 16, 1998

[51] Int. Cl.[7] ..... F41H 1/02

[52] U.S. Cl. ..... 2/2.5

[58] Field of Search ..... 2/2.5, 456

[56] References Cited

U.S. PATENT DOCUMENTS 4,287,607 9/1981 Leach ..... 2/2.5
5,373,582 12/1994 Dragone et al. ..... 2/2.5
5,479,659 1/1996 Bachner, Jr. ..... 2/2.5
5,619,748 4/1997 Nelson et al. ..... 2/2.5

*Primary Examiner*—Diana Oleksa
*Attorney, Agent, or Firm*—Wildman. Harrold, Allen & Dixon; Thomas J. Ring

[57] ABSTRACT

A ballistic resistant garment, having a top end and bottom end, for covering and protecting vital portions of a human body, which includes at least two panels having at least a first panel and a second panel which are adjacent and overlie one another in which each of the panels is constructed of a plurality of at least two layers of ballistic resistant material. The protective garment also includes a multiplicity of multi-panel securement stitches disposed in a row through the panels connecting the panels together in which the row is positioned in a direction angularly displaced from a substantially vertical direction determined generally between the top and bottom ends of the protective garment.

39 Claims, 5 Drawing Sheets

BALLISTIC RESISTANT GARMENT WITH MULTI-PANEL RADIAL SECUREMENT STITCHING

FIELD OF THE INVENTION

The present invention relates to ballistic resistant garments, and more particularly, to ballistic resistant garments having panels in which each panel has multiple layers of woven ballistic resistant material that are stacked together.

BACKGROUND OF THE INVENTION

Over the years there has been an evolution of protective garments. In the distant past there were protective armor garments that were both solid and jointed to permit some flexibility for movement. Such garments were relatively effective against missiles such as knives, spears, arrows and the like. However, these types of protective garments were disrcarded with the advent of firearms. These garments when constructed to be able to protect against firearms became too heavy, cumbersome and unwieldy.

In the past, strong aramid fibers and other similar fibers were developed which could be woven into a ballistic resistant cloth used to make protective garments capable of stopping various ballistic missiles such as bullets, shot, shell fragments, trauma and cutting instruments. Such garments are worn by police force personnel, military personnel and others who are potentially subjected to this type of deadly force. However, there has historically been heavy resistance in wearing these garments since they are relatively heavy, unwieldy and often times difficult to conceal.

In recent history, ballistic resistant garments have been developed which have enhanced characteristics of wearability and concealability. Such garments generally must contain improved balances of light weight, thin-ness, and flexibility to improve wearability and concealability, thereby improving end-user safety by increasing the likelihood that the protective garment will be worn.

However, improving wearability by reducing weight and improving thin-ness and flexibility without loss in needed ballistic performance has not been easy for the armor industry. Although much progress has been made on the performance side, that progress has been severely hampered by certain conditions of the controversial voluntary National Institute of Justice STD 0101.03 ("03"). This "03" standard specifies conditions for laboratory testing that cause lighter, thinner and more flexible designs to experience what are known as "bunching and balling" and/or "shifting". These problems in the laboratory test frequently lead to unpredictable and unrealistic "failures" in the laboratory which are not indicative of armor field performance on a dynamic, elastic human torso.

The repetitive multi-hit, multi-angle protocol of "03" which is shot on inelastic modeling clay can disadvantageously cause severe uncontrolled "bunching and balling" of the anti-ballistic pac, with resultant disorientation and separation of the ballistic layers. This can lead to uncontrolled and unrealistic loss of ballistic integrity and "penetration failure" in the laboratory.

The repetitive multi-hit, multi-angle protocol of "03" which is shot on inelastic modeling clay can also disadvantageously cause "shifting" of the anti-ballistic pac inside its removable carrier in a way that results in a "fair hit" shot striking the carrier in the correct place but missing, or barely grazing, the anti-ballistic pac. This too can result in a "penetration failure" even though the bullet may have never struck the anti-ballistic part.

Indeed "03" testing ballisticians are taught to do their best to create either "bunching or balling" or "shifting" failures during NIJ "03" certification testing.

Because of these problems thick, heavy, stiff and less wearable designs are much easier to pass through certification testing than light, thin, soft, flexible more wearable designs. This is true even though the lighter, thinner, softer and more wearable design might have equivalent or even higher actual ballistic stopping power as evidenced by scientifically reproducible V-50 Ballistic Limit tests (such as those used for research, development, old used vest studies and the world's military specifications).

In 1993, a revolutionary new ballistic resistant garment was developed that is now known as the MONARCH® (trademark of Second Chance Body Armor, Inc., Central Lake, Mich.). MONARCH® technology successfully reduced weight by 12–18% and improved thin-ness by about 20% while maintaining so much flexibility that the vest could literally be balled up in the end-user's hands. This so-called "fourth generation" technology involves revolutionary self-reinforcing fabrication techniques that resist "bunching and balling" and "shifting" in the laboratory during NIJ "03" certification testing without sacrificing softness and flexibility—i.e. improved wearability. These techniques are taught in U.S. Pat. No. 5,479,659 issued Jan. 2, 1996 to Bachner Jr.

Since 1993, the MONARCH® vest has become the "wearability standard". However, it has been learned that further improvements in wearability to fifth, sixth and/or seventh generations are required to off-set the problems in the flawed NIJ "03" laboratory test methods. Therefore, there is a need in the art for new and improved securement techniques which improve ballistic materials and produce further improvements in wearability while still successfully completing the NIJ "03" test protocol.

SUMMARY OF THE INVENTION

An object of the present invention is to provide a new and improved securement technique which improves ballistic materials and produces further improvements in wearability while still successfully completing the NIJ "03" test protocol.

Another object of the present invention is to provide a ballistic resistant garment, for covering and protecting vital portions of a human body which overcomes the disadvantages of known ballistic resistant garments. The present invention provides optimum levels of ballistic resistant protection while reducing the effects of bunching, balling and shifting upon multiple impacts in a laboratory test environment.

Another object of the present invention is to provide a ballistic resistant garment having a top end and bottom end, for covering and protecting vital portions of a human body, which includes at least two panels including means for forming at least a first panel and a second panel which are adjacent and overlie one another in which each of the at least two panels is constructed of at least two layers of ballistic resistant material. A multiplicity of stitches are disposed in a row through the two panels connecting the two panels together whereby the row of stitches is positioned in a direction angularly displaced from a substantially vertical direction determined generally between the top and bottom ends of the protective garment.

BRIEF DESCRIPTION OF THE DRAWINGS

The foregoing objects and advantageous features of the invention will be explained in greater detail and others will be made apparent from the detailed description of the preferred embodiments of the present invention which is given with reference to the several figures of the drawing, in which.

DESCRIPTION OF THE PREFERRED EMBODIMENTS

Figure 1:
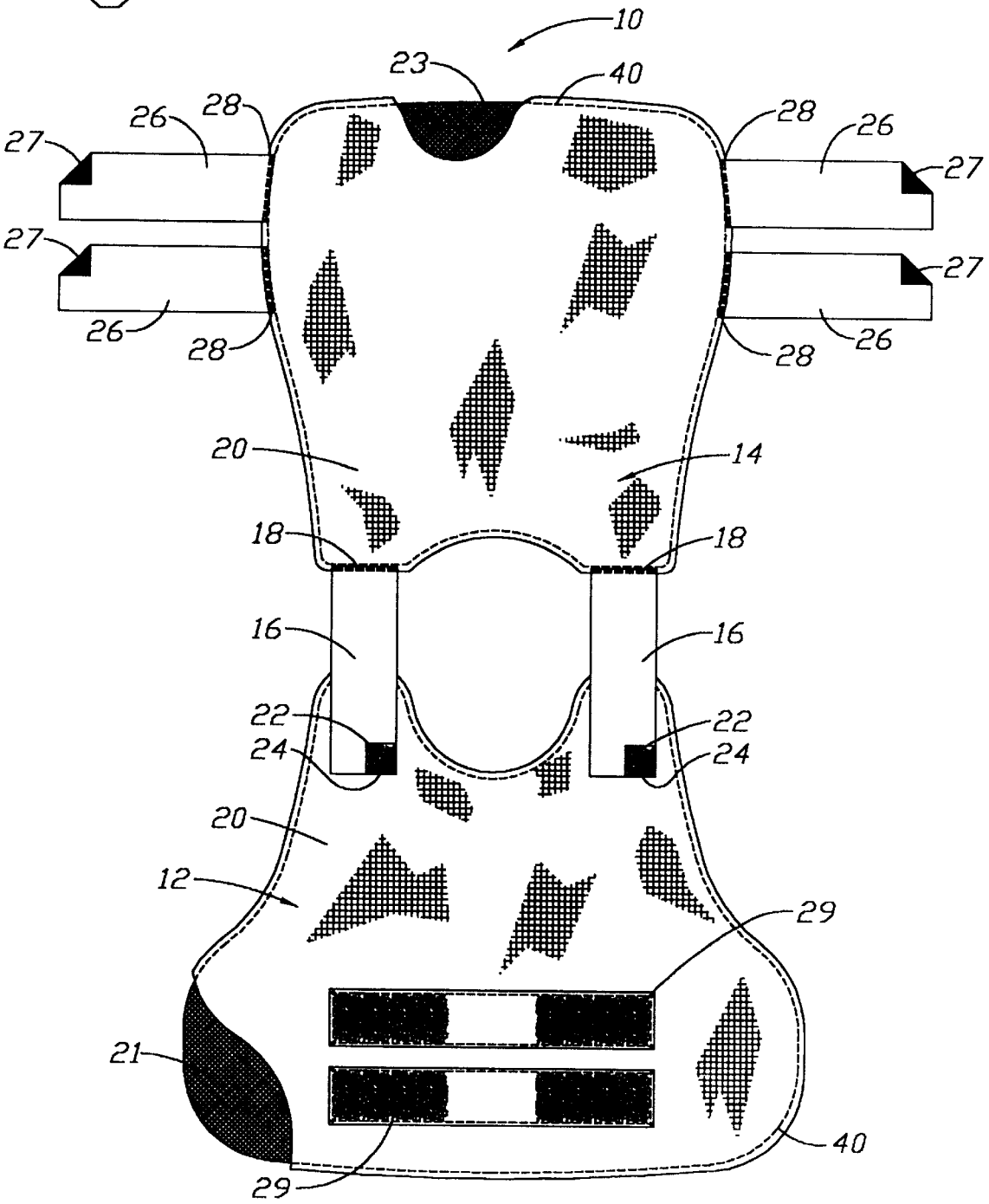
FIG. 1 is a partially broken away plan view of a ballistic resistant garment.

Referring now to FIG. 1, ballistic resistant garment 10 for covering and protecting vital portions proximate a torso region of a body supporting the garment is shown. The protective ballistic resistant garment 10 of FIG. 1 has a front garment section 12 for generally covering the front region of a wearer and a back garment section 14 for generally covering a back region of the wearer. Adjustably connecting the front section 12 and back section 14 are shoulder straps 16. The ends 18 of shoulder straps 16 are preferably secured (by stitching or other suitable means) to an outer cloth carrier 20 of the back section 14 of the garment. Carrier 20 carries front and back ballistic resistant pads 50 and 51 which are discussed in more detail below, in which each of these ballistic resistant pads are removable from carrier 20 for replacement when desired. Additionally, each ballistic resistant pad 50 and 51 is covered and enclosed within pad cover 21 and 23, respectively, preferably constructed of water resistant and vapor permeable material such as GORE-TEX®, as shown in the break away views of FIG. 1. As seen in FIG. 1, opposing ends 22 of the shoulder straps 16 are shown having releasably securable hook and loop fasteners or VELCRO® which engage corresponding mating fastener pad members 24 placed at a shoulder region of the outer cover 20 of the front garment section 12. The shoulder straps 16 are adjustable to move the front 12 and back 14 sections to a desired position over the torso region of the body of the wearer.

In use the front section 12 and back section 14 of the garment may also be suitably secured at their side regions by side straps 26. The side straps 26 are secured at one end 28 by stitching or other suitable means to the outer carrier 20 of the back section 14. The opposing ends 27 of the side straps 26 preferably have VELCRO® type hook and loop fasteners which are placed upon the outer cloth carrier at the front section 12 of the garment. The side straps 26 are pulled about the torso of the wearer and the free ends 27 are overlaid and engage mating pads 29 to comfortably fit the garment 10 about the body of the wearer.

Figure 2A:
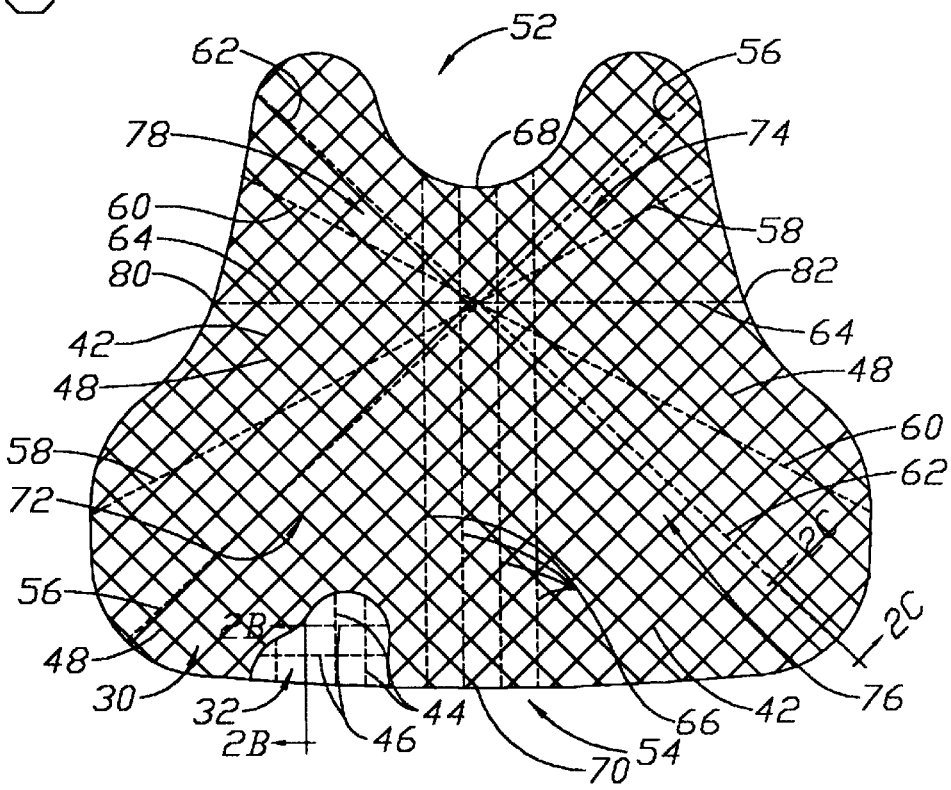
FIG. 2A is a plan view of a ballistic resistant pad for positioning within the garment in FIG. 1 and worn over the front portion of the torso of the wearer.
Figure 3A:
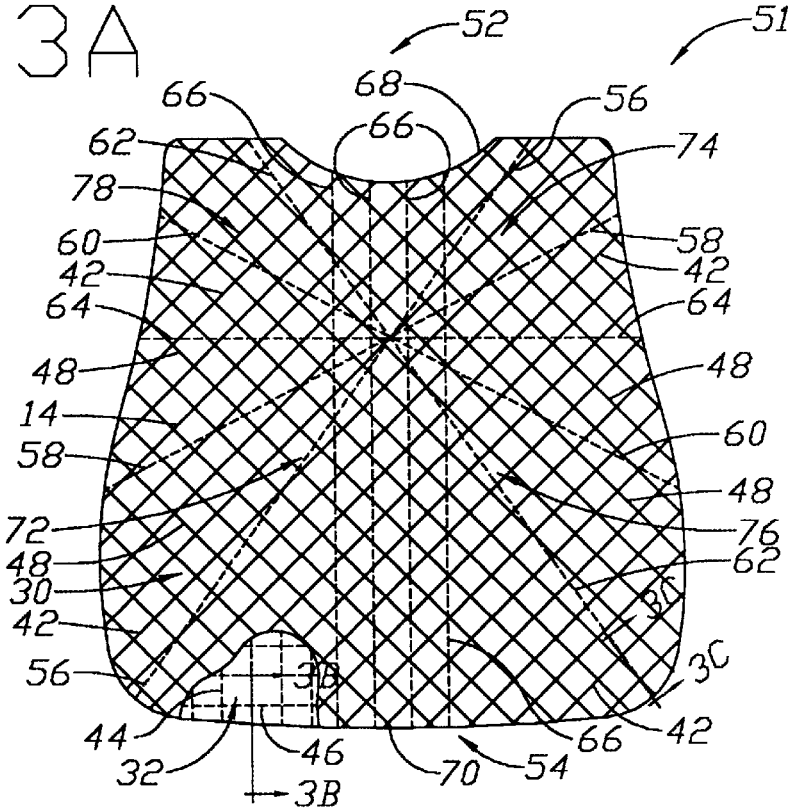
FIG. 3A is a plan view of a ballistic resistant pad for positioning within the garment in FIG. 1 and worn over the back portion of the torso of the wearer.
Figure 2B:
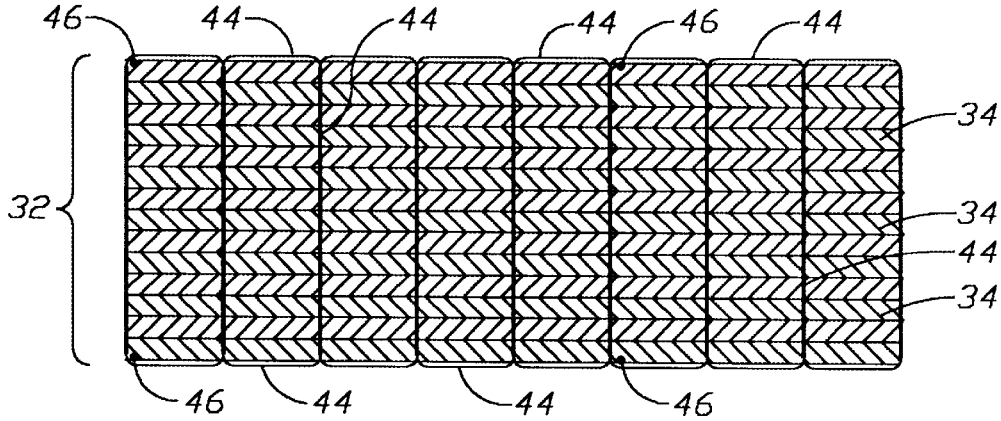
FIG. 2B is a cross section view of a sub-panel of the ballistic resistant pad of FIG. 2 as seen along line 2B—2B in FIG. 2A illustrative of thread locations.
Figure 2C:
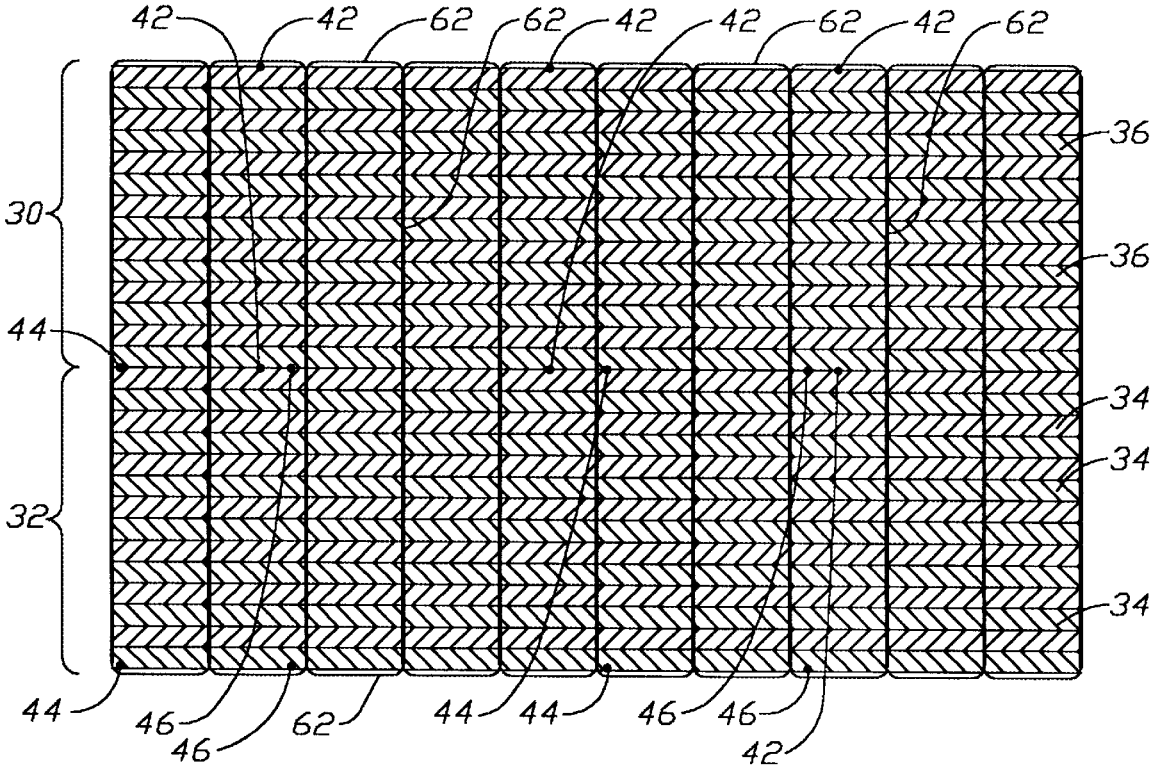
FIG. 2C is a cross section view of two sub-panels of the ballistic resistant pad of FIG. 2A as seen along a stitching line of the invention along line 2C—2C in FIG. 2A illustrative of thread locations.
Figure 3B:
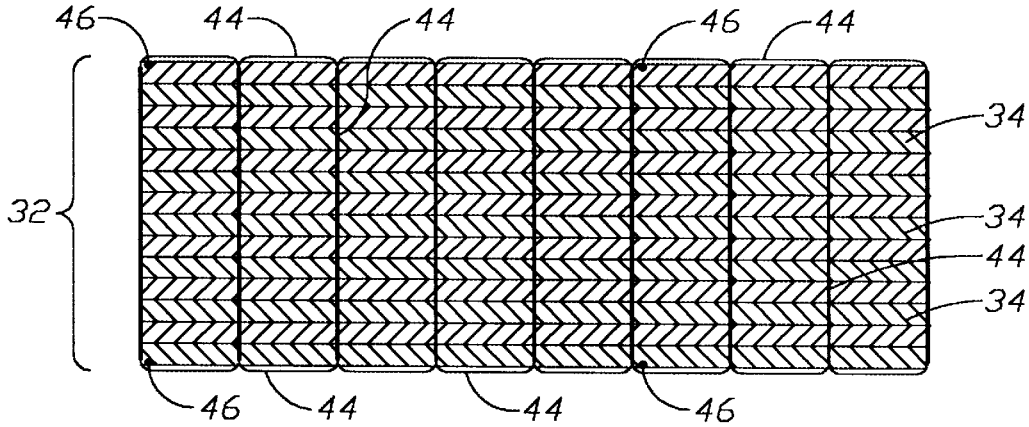
FIG. 3B is a cross section view of a sub-panel of the ballistic resistant pad of FIG. 3A as seen along line 3B—3B in FIG. 3A illustrative of thread locations.
Figure 3C:
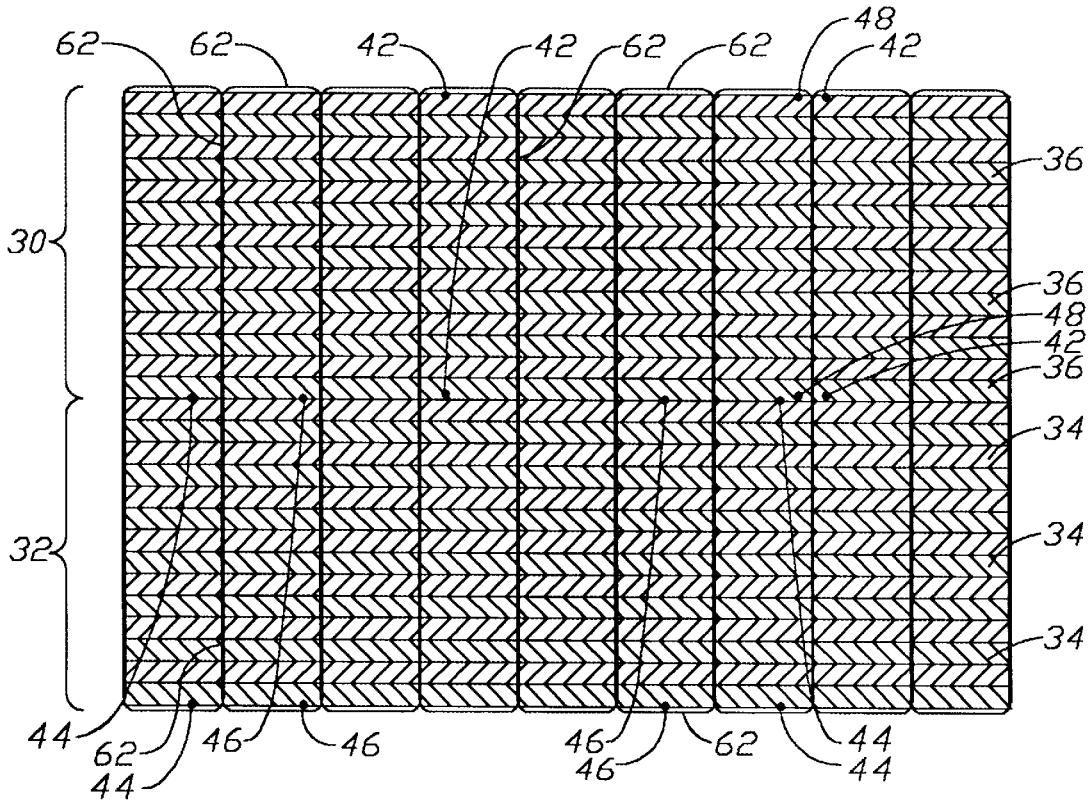
FIG. 3C is a cross section view of two sub-panels of the ballistic resistant pad of FIG. 3A as seen along a stitching line of the invention along line 3C—3C in FIG. 3A illustrative of thread locations.

As seen in FIGS. 2A and 3A, each of front section 12 and back section 14 of ballistic resistant garment 10, are seen without their respective pad covers which are discussed below thereby illustrating a front ballistic resistant pad 50, FIG. 2A, and a back ballistic resistant pad 51, FIG. 3A. Each of front and back garment pads 50, 51 have at least two panels 30, 32 which are adjacent and overlie one another. The plurality of adjacently engaged and overlying sub-panels 30, 32 form the protective ballistic resistant pads 50, 51. Each of panels 30, 32 is composed of at least two layers of ballistic resistant material 34, 36 as seen in FIGS. 2C and 3C. As seen in FIGS. 2B and 3B, the underlying protective panel 32 is formed of a plurality of layers 34 each constructed of ballistic resistant material. The embodiment in FIGS. 2B and 3B shows panel 32 having fourteen woven layers 34 of ballistic resistant material overlying one another, however, the number of layers 34 for each panel is suitably varied as needed. Likewise, as seen in FIGS. 2C and 3C, overlying panel 30 also has fourteen layers 36 of woven sheets of ballistic resistant material. Each panel 30, 32 in this embodiment seen in FIGS. 2C and 3C, preferably has the same number of layers 34, 36 of ballistic resistant material with each panel having substantially the same thickness. In accordance with the present invention, overlying panel 30 is formed of at least two ballistic resistant layers 36 and underlying panel 32 is formed of at least two ballistic resistant layers 34. Each of the layers 34, 36 of ballistic resistant material are co-extensive to one another with each layer having substantially the same shape.

The ballistic resistant layers 34 and 36, are typically each woven utilizing high tensile strength fibers such as aramids. Preferably, the ballistic resistant layers 34, 36 are constructed of TWARON® T-2000 microfilament fibers sold by AKZO NOBEL, Inc. and are woven into layered sheets having an imbalanced 24×22 weave. The high tensile strength TWARON® T-2000 aramid microfilament fiber preferably employed has a denier of 860 and a filament cross-overs of approximately 528,000,000 per square inch. Alternatively, KEVLAR® (a registered trademark) of DuPont Company, of Wilmington, Del. may be employed as a high tensile strength aramid fiber. In particular, KEVLAR® 129 having a denier of 840 may suitably be employed. For further details on the characteristics of woven layers of ballistic resistant materials preferably employed, reference may be made to U.S. Pat. No. 5,479,659 entitled "Lightweight Ballistic Resistant Garments And Method To Produce Same" issued Jan. 2, 1996, to Bachner, Jr. which is incorporated herein by reference. A wide range of fibers having various characteristics are selectively employed for constructing protective body armor panels in the soft ballistic resistant garment of the present invention. These fibers preferably have a denier in a range of 50 to 3000 grams/9000 meters. The woven material forming the layers of sheets or plies 34, 36 of ballistic resistant material is also composed of fibers that have a number of filaments in the range of 25 to 5000.

Advantageously, the combination of a thinner more wearable weave which is imbalanced with a suitable range of filament cross-over points is provided to dispense the energy from the bullet laterally so that the bullet does not penetrate. Thus, the present invention achieves efficient penetration resistance with less weight of ballistic resistant material. ARAFLEX® IV constructed of 840 to 865 denier aramid fiber, ARAFLEX® V constructed of 380 to 600 denier aramid fiber and ARAFLEX® VII constructed of 500 to 750 denier PBO (poly(p-phenylene-2, 6-benzobisoxazole)) fiber, are the fourth, fifth and seventh generations, respectively, of ballistic resistant material of Second Chance Body Armor, Inc. PBO is an isotropic crystal polymer high performance fiber of Toyobo Co., Ltd. of Osaka, Japan sold under the trademark $ZYLON_{198}$ . These materials are preferably employed in the soft body armor layers of the present invention.

The carrier 20 of FIG. 1 is preferably made of fabric material such as Nylon, Polyester, woven, mesh net, tricot net, or any other suitable cloth material. Pad covers 21 and 23 are preferably constructed of suitable waterproof and vapor permeable materials. It has been determined that non-water repellant materials tend to cause the ballistic resistant material to lose a portion of their ballistic resistant property when the same becomes wet greater than fifteen percent (15%) water by weight, and thus, waterproof material may be selectively employed. More particularly, waterproof and vapor permeable materials may be employed in conjunction with the construction of pad covers 21, 23 with the utilization of materials such as GORE-TEX (a registered trademark) of W. L. Gore & Associates, Inc. of Newark, Del., which is described in greater detail in U.S. Pat. No. 5,471,906.

Carrier 20, FIG. 1, is sewn together at its periphery by carrier stitching 40 around the pad cover and the encased ballistic resistant panels 30, 32, FIGS. 2A, 3A, positioned directly adjacent to one another and confined within the pad covers. The peripheral stitching 40 for carrier 20 does not impair the GORE-TEXO pad covers 21, 23, pair of panels 30, 32 or the plurality of layers 34, 36 of ballistic resistant materials forming the panels all enclosed within carrier 20. Moreover, the sub-panels 30, 32 forming the protective ballistic resistant pads contained within pad covers 21 and 23 and outer carrier 20 are preferably of the same shape in order to be closely confined within the pad covers 21, 23 and outer carrier 20, thereby maintaining panels 30, 32 in their desired operative position.

As seen in FIGS. 2A and 3A, a plurality of layer securement stitches 42 are disposed into first panel 30 which only connect the ballistic resistant layers 36 of the first panel 30. This can be seen in FIGS. 2A and 3A, in which, both front ballistic pad 50 and back ballistic resistant pad 51 of the garment are to be worn by wearer over the front and back portions of the wearer's torso respectively. For purposes of the present description, of this feature, the structural description will equally apply to the front garment section 12 as well as to the back garment section 14, as seen in FIGS. 2A and 3A.

The plurality of stitches 42 across top panel 30 are positioned in a row in a first direction. Another plurality of layer securement stitches 44, 46 which are disposed into the second underlying panel 32 only connecting, likewise, just the ballistic resistant layers 34 within second panel 32. These plurality of layer securement stitches are positioned in at least two rows 44, 46, in which the plurality of stitching rows 44, 46 are in a second (generally vertical) and third (generally horizontal) direction respectively, as seen in FIGS. 2A and 3A. Second and third directions of stitching 44 and 46 are transverse to one another. Additionally, row 42 of stitching having first direction across first panel 30 is transverse to two rows 44, 46 positioned in the aforementioned second and third directions across the second or underlying panel 32, as also seen in FIGS. 2A and 3A.

As seen in FIGS. 2A and 3A, the plurality of stitching rows 42 securing the layers 36 of panel 30 are spaced apart and are substantially parallel to one another a first direction. Also seen in FIGS. 2A and 3A the top panel 30 further includes a plurality of other crossing rows of layer securement stitches 48 spaced apart from one another and substantially parallel to one another in which the rows 42 of stitches in the first direction and the plurality of other rows 48 securing the layers 36 of ballistic resistant material are transverse to one another and in this embodiment substantially perpendicular to one another. Moreover, the rows of layer securement stitches 42, 48 of first panel 30 each extend substantially across first panel 30, as seen in FIGS. 2A and 3A. In the embodiment shown, the rows of layer securement stitches 42, 48 of first overlying panel 30 form a pattern of quilt stitches in first panel 30.

In referring to the second underlying panel 32, as seen in FIGS. 2A and 3A, the rows of layer securement stitches 44 are spaced apart from one another, are substantially parallel to one another and are positioned in second direction or generally vertical direction as seen in this embodiment. The underlying second panel 32 further has another plurality of rows of layer securement stitches 46 spaced apart from one another which are substantially parallel to one another and are positioned in a third direction or generally horizontal direction in this embodiment. The generally vertical rows of stitches 44 and the generally horizontal rows of stitches 46 are preferably positioned substantially perpendicular to one another, as seen in FIGS. 2A and 3A. Rows of stitches 44, 46 of second panel 32 each extend substantially across second panel 32. As a result, in this embodiment the plurality of the rows of stitches 44, 46 of second panel 32 form a pattern of box stitches.

These plurality of rows of layer securement stitches 42, 48 and 44, 46 are all composed of a high tensile strength fiber such as an aramid or such other suitable material. Preferably, aramids are employed as the stitching material to hold together the ballistic resistant layers 34, 36. The plurality of rows of layer securement stitches extend entirely through each of the layers of ballistic resistant material which results in the forming of the individual panels. The layer securement stitches 42 and 48 are completely disposed through each of the ballistic resistant plies 36 to form and establish top sub-panel 30. In similar fashion, the underlying sub-panel 32 is formed by the box stitching pattern of layer securement stitches 44 and 46 which only connect the ballistic resistant layers 34 together. The layer securement stitches 42, 48 for panel 30 and the layer securement stitches 44, 46 for panel 32 preferably only connect the layered sheets of ballistic resistant material for their respective panels in order to define the distinct sub-panels within the front and back ballistic resistant pads 50, 51. Individual sub-panels may alternatively be formed by other suitable securement approaches such as stitching about the periphery of ballistic resistant layers, bar tacs, non-invasive securement of the layers and the like.

As shown in FIGS. 2A, 3A, first panel 30 may selectively contain a pattern of quilt stitches 42, 48 positioned substantially across panel 30 and second panel 32 may selectively contain a pattern of box stitches 44, 46 positioned substantially across panel 32. As discussed in more detail in U.S. Pat. No. 5,479,659 referenced above and incorporated herein, these stitching patterns in the different panels 30, 32 which overlie one another provide transference of energy at time of impact by a bullet.

To reduce the effects of bunching, balling and shifting, seen in ballistic laboratory testing, of the ballistic resistant layers thereby maintaining the ballistic resistant panels in their desired position during testing, additional stitching extending entirely through and securing each of the plurality of panels 30, 32 in the ballistic resistant pads together has been added and forms part of the present invention. This improvement provides the wearer further assurance of performance of garment 10 while maintaining a high degree of wearability.

As seen in FIGS. 2A and 3A, the ballistic resistant garment 10 of the present invention includes a plurality of radial multi-panel panel securement stitches 56, 58, 60, 62, 64 which extend entirely through the ballistic resistant panels 30, 32 securing them together. The radial stitches 56,58,60,62,64, seen in the embodiment of FIGS. 2A and 3A advantageously provide improved laboratory performance against multiple impacts striking at various angles and at different regions of the garment without appreciably detracting from wearability.

The ballistic resistant garment 10, FIGS. 2A, 3A, is shown having a top end 52 and a bottom end 54, with multiple panels 30, 32 each preferably constructed of a plurality of layered plies of woven ballistic resistant material. A multiplicity of stitches are disposed in a row for each row of multi-panel securement stitches 56, 58, 60, 62, 64 which are sewn entirely through the ballistic resistant panels 30, 32 in order to secure the panels together. The rows of radial stitching 56, 58, 60, 62, 64, FIGS. 2A, 3A, sewn through the ballistic resistant pads 50, 51 securing panels 30 and 32 together, are each positioned in a direction angularly displaced from a substantially vertical direction determined between the top end 52 and the bottom end 54 of the garment. Additionally, as also seen in FIGS. 2A and 3A, a plurality of vertical rows of stitches 66 are also disposed and secured entirely through the ballistic resistant panels 30, 32. The stitching rows 66 continuously extend in a substantially vertical direction between top edge 68 and bottom edge 70 of the ballistic resistant panels 30, 32.

As seen in the embodiment of FIGS. 2A and 3A, the rows 56, 58, 60, 62, 64 of radial stitching preferably extend across the width from one edge to an opposing edge of the panels 30, 32. Moreover, the multi-panel securement stitches will include a number of pattern configurations which include at least one of the first through fifth rows of stitches described hereinbelow.

A first row of multi-panel securement stitches 56 continuously extends in substantially a straight line from an edge of a lower left portion 72 of the ballistic resistant panels 30, 32 and extends diagonally across the panels to an opposing edge of an upper right portion 74 of the panels. A second row of multi-panel securement stitches 62 continuously extends from an edge of a lower right portion 76 of the panels 30, 32 diagonally across the panels to an upper left portion 78 of the panels. A third row of multi-panel securement stitches 64 continuously extends horizontally from left edge 80 of the panels 30, 32 across the panels to an opposing right edge 82 of the panels.

As further seen in the embodiment of FIGS. 2A and 3A, a fourth row of multi-panel securement stitches 58 continuously extends substantially in a straight line from an edge of the lower left portion 72 of the panels to an opposing edge generally in the upper right portion 74 of the panels. The intermediate fourth row of stitches 58 at the edge of the lower left portion 72 is positioned between the horizontally extending third row of stitches 64 and the first row of stitches 56. Additionally, the intermediate fourth row of multi-panel securement stitches 58 continuously extends to an opposing edge in the upper right portion 74 of the panels 30, 32 where stitches 58 are positioned between the horizontally extending third row of multi-panel securement stitches 64 and the first row of multi-panel securement stitches 56 that extend from the lower left portion of the panels to the upper right portion. FIGS. 2A and 3A also illustrate an intermediate fifth row of multi-panel securement stitches 60 which at the edge of the ballistic resistant pad is positioned generally between the horizontally extending third row of stitches 64 and the diagonally extending second row of stitches 62. The fifth row of multi-panel securement stitches 60 substantially continuously extends from an edge of the lower right portion 76 of the panels and is positioned between the third row of stitches 64 and the second row of stitches 62. The intermediate fifth row of stitches 60 extends to an opposing edge of the panels positioned between the third row of stitches 64 and the second row of stitches 62 in the upper left portion 78 of the panels. Rows of multi-panel securement stitches 58, 60 generally pass through the central or sternum area of panels 30,32 in FIG. 2A and through the central or between the shoulder blade area of panels 30,32 in FIG. 3A.

The extended rows of radial stitches 56, 58, 60 and 62 are preferably positioned, with respect to the wearer, in the lower left portion, lower right portion, upper left portion and upper right portion of the panels forming the ballistic resistant pad. The edge to edge rows of radial stitches 56, 58, 60, 62, 64 sewn through and across the ballistic resistant panels 30, 32 reduces shifting and binding movement of the ballistic resistant layers and the pads, especially upon receipt of multiple ballistic impacts as seen in a body armor testing laboratory environment.

As seen in FIG. 2A, row of stitches 56 continuously extends in substantially a straight line from edge to edge across the panels 30, 32 on the front garment section 12 from the lower left portion 72 to the upper right portion 74 of the panels. The row of stitches 56 across panels 30, 32 on the front garment section 72 seen in FIG. 2A, pass over a sternum area of the wearer upon the panels being worn over the front torso of the wearer. Similarly, row of stitches 62 continuously extending from the lower right portion 76 to the upper left portion 78 of the panels 30, 32 of the front ballistic resistant pad 50, FIG. 2A, also pass over the sternum area of the wearer upon the panels being worn over a front torso.

As seen in FIG. 3A, the row of stitches 56 extending from the lower left to the upper right panel portions of back ballistic resistant pad 51 passes an area section of the panels defined generally between a pair of shoulder blades of the wearer with the panels being worn over the back torso. Also seen in FIG. 3A, the row of stitches 62 extending in a crossing fashion across panels 30, 32 of the back garment section 14, from the lower right to the upper left portions of the panels passes over a section between the shoulder blades upon the garment being worn over the back of the torso of the wearer.

As seen in FIGS. 2A and 3A, row 64 of multi-panel securement stitches is positioned in a horizontal direction determined generally between the right edge 82 and left edge 80 of the panels 30, 32 and row 64 further horizontally extends completely across the panels from the right edge to the left edge. As seen in FIG. 2A, horizontal row of stitches 64, continuously extending in substantially a straight line across the width of the panels, also passes over the sternum area of the wearer with the panels 30, 32 being positioned over the front of the wearer's torso. As seen in FIG. 3A, horizontal row 64 of stitches placed through panels 30, 32 along the back pad 51 pass over the pair of shoulder blades of the wearer upon the panels being positioned over the back of the wearer's torso.

The plurality of vertical rows of stitches 66, FIGS. 2A, 3A, are disposed entirely through ballistic resistant panels 30, 32 and continuously extend in a vertical direction from the top edge 68 to the bottom edge 70 of the panels. The plurality of vertical rows of stitches 66 are positioned in the central part of the co-extensive ballistic resistant panels 30, 32 between the right edge 82 and the left edge 80 of the panels. As seen in FIG. 2A, the four vertical rows of stitches 66 are positioned over the sternum area of the wearer upon the ballistic resistant panels 30, 32 of front pad 50 being worn over the body of the wearer. As seen in FIG. 3A, four vertical rows of stitches 66 are generally positioned between the shoulder blades of the wearer upon the panels of back ballistic resistant pad 51 being worn over the back of the wearer.

Referring to FIGS. 2B and 2C, closer cross-sectional views of the construction of front ballistic pad 50 of FIG. 2A are shown as well as being illustrative of thread locations. In FIG. 2B, cross-sectional view along line 2B—2B of FIG. 2A, illustrates underlying panel 32 being constructed of layers of plies of ballistic resistant material 34. Layer securement stitches 44, 46 penetrate each of the layers 34 to form panel 32 and also provide the box stitching pattern in ballistic pad 50, as seen in FIG. 2A. Stitches 44 run in generally a vertical direction with each of the rows of stitches preferably spaced approximately 1 ¼ inches apart. Similarly, stitches 46 which run in generally a horizontal direction preferably have the rows of the horizontal stitches spaced approximately 1 ¼ inches apart.

In FIG. 2C, both underlying panel 32 and overlying panel 30 are shown forming front ballistic pad 50. As mentioned above, underlying panel 32 is constructed of woven layers of ballistic resistant material 34 and overlying panel 30 is constructed of woven layers of ballistic resistant material 36. With regard to overlying panel 30, layer securement stitches 42 which generally run from the lower left direction to the upper right direction relative to pad 50 are seen in FIG. 2C. From this particular cross sectional view in FIG. 2C which is taken along lines 2C—2C from FIG. 2A, stitches 48, which run from the lower right direction to the upper left direction relative to pad 50, which compliment stitches 42 in forming the quilt pattern, are not seen. Rows of stitches 42 are preferably spaced approximately 1 ¼ inches apart and similarly, stitches 48 are preferably spaced approximately 1 ¼ inches apart. Layer securement stitches 42, 48 arranged in a quilt pattern penetrate each of the plurality of flexible layers 36 of woven ballistic resistant material to form panel 30. Row of radial multi-panel stitches 62 are seen, since the view in FIG. 2C is taken along row of radial stitches 62, positioned between row of stitches 48. As seen in FIG. 2C, radial multi-panel securement stitches 62 penetrate entirely through and secure panels 30 and 32 together. As to underlying panel 32, in FIG. 2C, layer securement stitches 44, 46 which form a box stitch pattern in panel 32 and secure ballistic resistant layers 34 together, are shown.

Referring now to FIGS. 3B and 3C, a closer cross-sectional view of the construction of back ballistic pad 51, of FIG. 3A are shown as well as being illustrative of thread locations. In FIG. 3B, underlying panel 32 constructed of layers of ballistic resistant material 34 is shown. Layer securement stitches 44, 46 form the box stitching pattern in ballistic pad 51, as seen in FIG. 2A. Since the view of FIG. 3B is taken along a row of vertical layer securement stitches 44, the layer securement stitches 44 are clearly shown extending through and securing each of the ballistic resistant layers 34 together. Horizontal layer securement stitches 46 are shown where they generally intersect with stitches 44. Stitches 44 run in generally a vertical direction with the rows of stitches 44 preferably spaced approximately 1 ¼ inches apart. Similarly, stitches 46 which run in generally a horizontal direction with rows of stitches 46 spaced approximately 1 ¼ inches apart.

In FIG. 3C, both underlying panel 32 and overlying panel 30 are shown forming back ballistic pad 51. As mentioned above, underlying panel 32 is constructed of layers of ballistic resistant material 34 and overlying panel 30 is constructed of ballistic resistant material 36. With regard to overlying panel 30, layer securement stitches 42 which generally run from the lower left direction to the upper right direction relative to pad 51 are seen in FIG. 3C, likewise layer securement stitches 48, which run from the lower right direction to the upper left direction relative to pad 51 which compliment stitches 42 in forming the quilt pattern, are also seen. Layer securement stitches 42, 48 penetrate ballistic resistant layers 36 and form overlying panel 30. Rows of stitches 42 are preferably spaced approximately 1 ¼ inches apart and similarly, stitches 48 are preferably spaced approximately 1 ¼ inches apart forming the quilt pattern. Additionally, row of radial multi-panel securement stitches 62 are seen, since the view in FIG. 3C is taken along the row of radial stitches 62. As seen in the cross sectional view of FIG. 3C, multi-panel securement stitches 62 penetrate through and secure panels 30 and 32 together. As to underlying panel 32, in FIG. 3C, layer securement stitches 44, 46 which form a box stitch pattern in panel 32 and secure ballistic resistant layers 34 together, are shown where they generally cross in the view of FIG. 3C.

Figure 4:
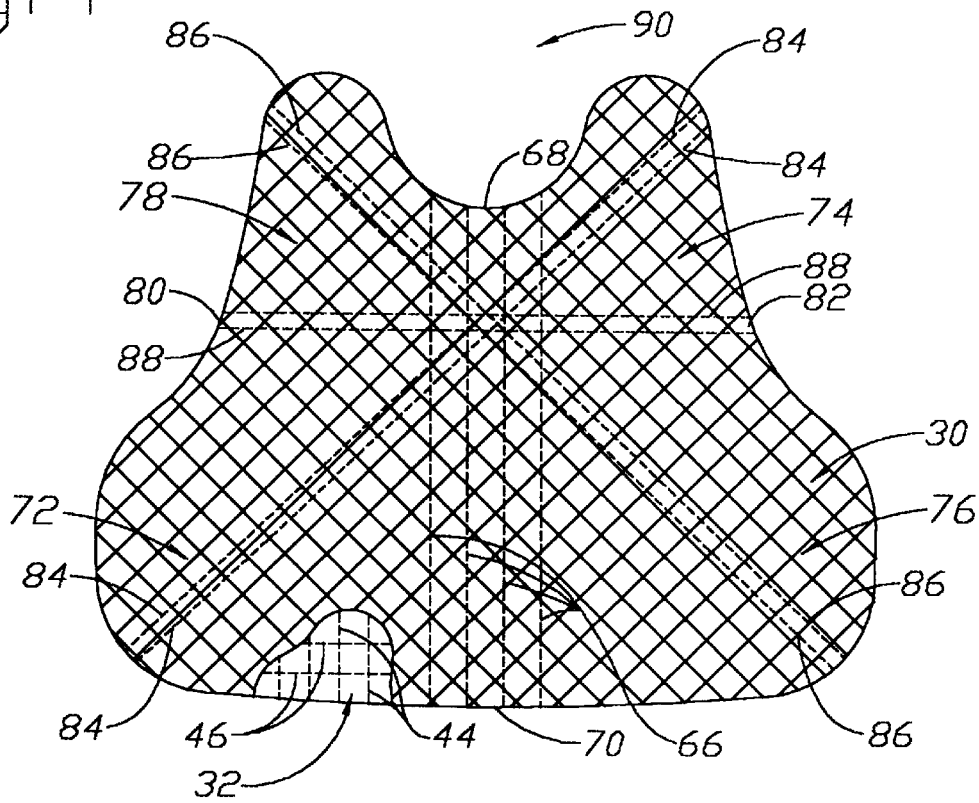
FIG. 4 is a plan view of another embodiment of the invention as shown in FIG. 2A.

Referring now to FIG. 4, an alternative embodiment is shown having a plurality of groups of radial multi-panel securement stitching rows with the rows of stitches being aligned in parallel. This embodiment of multi-panel securement stitching rows includes at least one of the following described first, second and third groups of stitching hereinafter described. The ballistic resistant pad 90 of FIG. 4 includes front panel or strike face panel 30 having an arrangement of quilt stitching and the underlying panel 32 having box stitching as described with reference to FIGS. 2A and 3A. A plurality of vertical stitching rows 66, FIG. 4, are also provided which are sewn through each ballistic resistant panel 30, 32 to secure them together.

As seen in FIG. 4, a first group formed of two rows of adjacently aligned parallel multi-panel securement stitches 84 which substantially continuously extend from an edge at the lower left portion 72 of panels 30, 32 to an opposing edge at the upper right portion 74 of the panels. The first group 84 of rows of parallel stitches substantially continuously extend diagonally across the central region of panels 30, 32 over a sternum area of the wearer with the panels being positioned over the front of the torso. A second group of another plurality of rows of parallel multi-panel securement stitches 86, FIG. 4, continuously extend from an edge of a lower right portion 76 of the ballistic resistant panels 30, 32 diagonally across the central or sternum region of the panels, to the opposing edge of the upper left 78 portion of the panels.

The embodiment of FIG. 4 also illustrates a third group of rows of parallel stitches 88 which continuously extend horizontally from the left edge 80 to the right edge 82 across the panels 30, 32 over the sternum area of the wearer upon the garment being worn over the front torso of the user. The groups of rows of horizontally spaced multi-panel securement stitches 84, 86, 88 of FIG. 4, each extend entirely through all the layers of ballistic resistant material for each of the panels 30, 32 in the garment. Preferably, each group has at least two rows of parallel stitches extending across and entirely through the panels. As seen in FIG. 4, each group 84, 86, 88 shown has a pair of parallel spaced rows of stitches, however more than two rows for each group may suitably be employed.

The rows of stitches 56, 58, 60, 62, 64, 66, 84, 86, 88 described herein are preferably constructed of high tensile strength fibers such as KEVLAR® made by DuPont Company or TWARON® made by AKZO NOBEL, Inc.

Many embodiments of the present invention are contemplated. Another embodiment includes having the multiplicity of multi-panel securement stitches be positioned as at least one row of stitches 88 positioned in substantially a horizontal direction extending generally between a left and right edges, 80, 82. This row of stitches 88 also extend to the left and right edges, 80, 82, as seen, for example, in ballistic pad 90, in FIG. 4.

Figure 5:
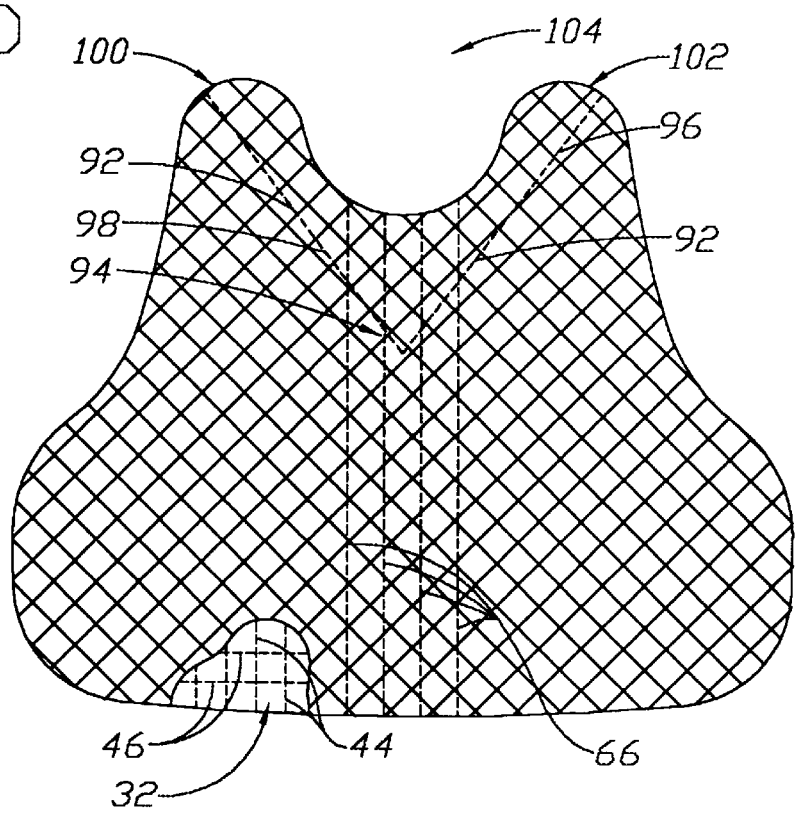
FIG. 5 is plan view of another embodiment of the invention, as shown in FIG. 2A.

Another embodiment of the present invention includes having the multiplicity of stitches include row of stitches 92 which form generally a V shape configuration 94, as seen in FIG. 5. It is also contemplated that a plurality of rows of stitches that entirely go through the ballistic resistant pad may alternatively form a generally V shaped configuration. This generally V shape 94 has two legs 96, 98 in which each leg extends substantially to the edges 100, 102 of the ballistic resistant pad 104.

While a detailed description of the preferred embodiments of the invention has been given, it should be appreciated that many variations can be made thereto without departing from the scope of the invention set forth in the appended claims.

What is claimed is:

1. A ballistic resistant garment having a top end and bottom end, for covering and protecting vital portions of a human body, comprising:

at least two panels including at least a first panel and a second panel which are adjacent and overlie one another in which both the first panel and second panel each have at least two layers of ballistic resistant material;

means for securing the at least two layers of the first panel together to form the first panel;

means for securing the at least two layers of the second panel together independent of the securing means for the first panel to form the second panel; and a multiplicity of multi-panel securement stitches disposed in a row through the panels connecting the panels together in which said row is positioned in a direction angularly displaced from a substantially vertical direction determined generally between the top and bottom ends of the protective garment.

2. The ballistic resistant garment of claim 1 in which the at least two layers of both the first panel and second panel are each woven.

3. The ballistic resistant garment of claim 2 wherein the woven layers are constructed of high tensile strength fibers.

4. The ballistic resistant garment of claim 3 in which the fibers are aramid.

5. The ballistic resistant garment of claim 1 in which the panels are positioned adjacent to one another.

6. The ballistic resistant garment of claim 1 in which the panels are substantially enclosed within a pad cover member.

7. The ballistic resistant garment of claim 6 in which said pad cover member is constructed of waterproof and vapor permeable material.

8. The ballistic resistant garment of claim 1 in which each layer of ballistic resistant material in at least one of the panels are substantially the same shape.

9. The ballistic resistant garment of claim 1 including at least one row of multi-panel securement stitches disposed through said at least two panels which extends in said substantially vertical direction between a top edge and a bottom edge of said at least two panels.

10. The ballistic resistant garment of claim 9 in which said at least one row of multi-panel securement stitches which extends in said substantially vertical direction extends to said top and bottom edges of said at least two panels.

11. The ballistic resistant garment of claim 10 in which said at least one row of multi-panel securement stitches which extends in said substantially vertical direction is positioned centrally between a right edge and a left edge of the panels.

12. The ballistic resistant garment of claim 11 in which said at least one row of multi-panel securement stitches which extends in said substantially vertical direction is adapted to be positioned generally over a sternum area of a wearer upon said at least two panels being worn over the body of the wearer.

13. The ballistic resistant garment of claim 12 in which said at least one row of multi-panel securement stitches is adapted to be positioned generally between the shoulder blades of the wearer upon the panels being worn over the back of the wearer.

14. The ballistic resistant garment of claim 1 in which the multiplicity of multi-panel securement stitches includes at least one row of stitches which is positioned, with respect to the wearer, in at least one of a lower left portion, lower right portion, upper left portion and upper right portion of the panels.

15. The ballistic resistant garment of claim 14 in which the at least one row of multi-panel securement stitches extends to an edge of the panels within respectively, at least one of said lower left portion, lower right portion, upper left portion and upper right portion of the panels.

16. The ballistic resistant garment of claim 14 in which the at least one row of multi-panel securement stitches substantially continuously extends from the lower left portion to the upper right portion of the panels and is adapted to pass over a sternum area of the wearer with the panels over a front of a torso.

17. The ballistic resistant garment of claim 14 in which the at least one row of multi-panel securement stitches substantially continuously extends from, the lower right portion to the upper left portion of the panels and is adapted to pass over a sternum area of the wearer with the panels over a front of a torso.

18. The ballistic resistant garment of claim 14 in which the at least one row of multi-panel securement stitches substantially continuously extends from the lower left portion to the upper right portion of the panels passing over a section of the panels generally adapted to be positioned between a pair of shoulder blades of the wearer with the panels over a back of a torso.

19. The ballistic resistant garment of claim 14 in which the at least one row of multi-panel securement stitches substantially continuously extends from, the lower right portion to the upper left portion of the panels passing over a section of the panels generally adapted to be positioned between a pair of shoulder blades of the wearer with the panels over a back of a torso.

20. The ballistic resistant garment of claim 1 in which the multiplicity of multi-panel securement stitches includes at least one row of stitches positioned in a substantially horizontal direction determined generally between a right and left edge of the panels.

21. The ballistic resistant garment of claim 20 in which the at least one row of multi-panel securement stitches is adapted to pass over a sternum area of the wearer with the panels positioned over a front of a torso.

22. The ballistic resistant garment of claim 20 in which the at least one row of multi-panel securement stitches is adapted to pass over a pair of shoulder blades of the wearer with the panels positioned over a back of a torso.

23. The ballistic resistant garment of claim 1 in which the multiplicity of stitches includes at least one of a.), b.), c.), d.) and e.):

a.) a first row of multi-panel securement stitches which extend from an edge of a lower left portion of the panels and extend diagonally across the panels and are adapted to extend over a sternum area of the wearer, with the panels positioned over the front of the torso, to an opposing edge of an upper right portion of the panels, b.) a second row of multi-panel securement stitches which extend from an edge of a lower right portion of the panels and extend diagonally across the panels which are adapted to extend over the sternum area of the wearer to an opposing edge of an upper left portion of the panels, c.) a third row of multi-panel securement stitches which extend horizontally from a left edge of the panels across the panels and are adapted to extend over the sternum area of the wearer to an opposing right edge of the panels, d.) a fourth row of multi-panel securement stitches which extend from an edge of the lower left portion of the panels positioned between the third row of stitches and the first row of stitches and in which the fourth row extends to an opposing edge of the panels positioned between the third row of stitches and the first row of stitches in the upper right portion of the panels, and e.) a fifth row of multi-panel securement stitches which extend from an edge of the lower right portion of the panels positioned between the third row of stitches and the second row of stitches and in which the fifth row extends to an opposing edge of the panels positioned between the third row of stitches and the second row of stitches in the upper left portion of the panels.

24. The ballistic resistant garment of claim 23 in which the multiplicity of multi-panel securement stitches includes all of a.), b.), c.), d.) and e.).

25. The ballistic resistant garment of claim 23 in which the multiplicity of multi-panel securement stitches includes a.), b.) and c.).

26. The ballistic resistant garment of claim 23 in which the multiplicity of multi-panel securement stitches includes a.) and b.).

27. The ballistic resistant garment of claim 1 in which the multiplicity of multi-panel securement stitches includes at least one of a.), b.), and c.):

a.) a first group of a plurality of at least two rows of parallel multi-panel securement stitches which extend from an edge of a lower left portion of the panels and extend diagonally across the panels and are adapted to extend over a sternum area of the wearer, with the panels positioned over the front of the torso, to an opposing edge of an upper right portion of the panels, b.) a second group of another plurality of at least two rows of parallel multi-panel securement stitches which extend from an edge of a lower right portion of the panels and extend diagonally across the panels and are adapted to extend over the sternum area of the wearer to an opposing edge of an upper left portion of the panels, and c.) a third group of at least two rows of parallel multi-panel securement stitches which extend horizontally from a left edge of the panels across the panels and are adapted to extend over the sternum area of the wearer to an opposing edge on the right edge of the panels.

28. The ballistic resistant garment of claim 1, in which the multiplicity of multi-panel securement stitches includes at least one row of stitches which form generally a V shaped configuration.

29. The ballistic resistant garment of claim 28, in which said generally V shaped configuration has two legs and each leg extends to substantially an edge of the ballistic resistant pad.

30. The ballistic resistant garment of claim 1 in which the securing means of the first panel includes a plurality of layer securement stitches disposed into the first panel only connecting the at least two layers of ballistic resistant material together within the first panel.

31. The ballistic resistant garment of claim 30 in which the securing means of the second panel includes another plurality of layer securement stitches which are disposed into the second panel only connecting the layers of ballistic resistant material together within the second panel.

32. A ballistic resistant garment having a top end and bottom end, for covering and protecting vital portions of a human body, comprising:

at least two panels including means for forming at least a first panel and a second panel which are adjacent and overlie one another in which each of the at least two panels is constructed of at least two layers of ballistic resistant material;

a multiplicity of multi-panel securement stitches disposed in a row through the panels connecting the panels together in which said row is positioned in a direction angularly displaced from a substantially vertical direction determined generally between the top and bottom ends of the protective garment;

a plurality of layer securement stitches of the forming means disposed into the first panel only connecting said at least two layers of ballistic resistant material within the first panel in which said plurality of layer securement stitches are positioned in a row in a first direction; and another plurality of layer securement stitches which are disposed into the second panel only connecting the layers of ballistic resistant material within said second panel, in which the other plurality of layer securement stitches are positioned in at least two rows, in which said at least two rows are in a second and third direction respectively, in which said second and third directions are transverse to one another and in which the row of layer securement stitches in said first direction of said first panel is transverse to said two rows of layer securement stitches in said second and third directions of said second panel.

33. The ballistic resistant garment of claim 32 in which the plurality of layer securement stitches and the other plurality of layer securement stitches are both composed of a high tensile strength fiber.

34. The ballistic resistant garment of claim 33 in which said fiber is constructed of an aramid.

35. The ballistic resistant garment of claim 34 in which the plurality of layer securement stitches disposed in the first panel includes a plurality of rows of layer securement stitches spaced apart and substantially parallel to one another in said first direction and includes a plurality of other rows of layer securement stitches spaced apart from one another and substantially parallel to one another in which the plurality of rows and the plurality of other rows are transverse to one another, and in which the other plurality of layer securement stitches disposed in the second panel includes a plurality of rows of layer securement stitches spaced apart from one another and substantially parallel to one another positioned in said second direction and another plurality of rows of layer securement stitches spaced apart from one another and substantially parallel to one another positioned in said third direction.

36. The ballistic resistant garment of claim 35 in which the plurality of rows and the plurality of other rows are perpendicular to one another in the second panel.

37. The ballistic resistant garment of claim 36 in which the plurality of rows and the other plurality of rows of layer securement stitches of the first panel each extend substantially across the first panel and in which the plurality of rows and the other plurality of rows of layer securement stitches of the second panel each extend substantially across said second panel.

38. The ballistic resistant garment of claim 37 in which the plurality of rows of layer securement stitches and the other plurality of rows of layer securement stitches of the first panel form a pattern of quilt stitches in the first panel and in which the plurality of rows and the plurality of other rows of layer securement stitches of the second panel form a pattern of box stitches.

39. A ballistic resistant garment having a top end and a bottom end, for covering and protecting vital portions of a human body, comprising:

at least two panels including means for forming at least a first panel and a second panel which are adjacent and overlie one another in which each of the at least two panels is constructed of at least two layers of ballistic resistant material; and a multiplicity of multi-panel securement stitches disposed in a row through the panels connecting the panels together in which said row is positioned in a direction angularly displaced from a substantially vertical direction determined generally between the top and bottom ends of the protective garment, in which the row of multi-panel securement stitches is positioned in a substantially horizontal direction determined generally between a right edge and a left edge of the panels in which the row substantially continuously extends to the right and left edges of the panels.

* * * * *

UNITED STATES PATENT AND TRADEMARK OFFICE

CERTIFICATE OF CORRECTION

PATENT NO : 6,026,509

DATED : February 22, 2000

INVENTOR(S) : Thomas E. Bachner, Jr.

It is certified that error appears in the above-identified patent and that said Letters Patent are hereby corrected as shown below:

Col. 5, line 33, delete "GORE-TEXO" and insert - -GORE-TEX ® - -.

Signed and Sealed this

First Day of May, 2001

*Attest:*

Nicholas P. Godici

NICHOLAS P. GODICI

*Attesting Officer*

*Acting Director of the United States Patent and Trademark Office*